United States Patent [19]

Rutter

[11] Patent Number: 4,493,438

[45] Date of Patent: Jan. 15, 1985

[54] FLUID DISPENSER

[76] Inventor: Christopher C. Rutter, 21063 Cabot Blvd., Hayward, Calif. 94545

[21] Appl. No.: 396,622

[22] Filed: Jul. 9, 1982

[51] Int. Cl.[3] ..... B67B 7/24

[52] U.S. Cl. ..... 222/83; 222/553; 222/153

[58] Field of Search ..... 222/5, 80, 81, 82, 83, 222/83.5, 87, 88, 89, 541, 553, 105, 153

[56] References Cited

U.S. PATENT DOCUMENTS

| | | | |
|---|---|---|---|
| Re. 29,656 | 6/1978 | Chittenden et al. | 222/83 |
| 3,252,634 | 5/1966 | Scholle | 222/105 |
| 3,421,662 | 1/1969 | Hanson | 222/105 |
| 3,625,178 | 12/1971 | Prachar | 222/5 |
| 3,930,286 | 1/1976 | McGowen | 222/105 |
| 4,322,018 | 3/1982 | Rutter | 222/105 |

FOREIGN PATENT DOCUMENTS

| | | | |
|---|---|---|---|
| 655026 | 10/1964 | Belgium | 222/553 |
| 2051335 | 1/1981 | United Kingdom | 222/5 |
| 2082152 | 3/1982 | United Kingdom | 222/83 |
| 2088837 | 6/1982 | United Kingdom | 222/105 |

*Primary Examiner*—H. Grant Skaggs
*Attorney, Agent, or Firm*—Linval B. Castle

[57] ABSTRACT

A two-piece dispenser for flexible plastic fluid-containing bags. An outer tubular sleeve has a flange attached to the sealed fluid-containing bag. The bore of the sleeve has two annular grooves, one adjacent the bag surface, the other with a semicircular cross-section and displaced within the bore from the first groove. The second piece is a coaxial barrel having sharp piercing points on a plurality of long, flexible blades, at least one of which carries a tooth extending radially from the surface for engaging the annular grooves. In the first or semicircular cross-sectioned groove, the tooth operates to strongly resist longitudinal movement of the barrel so that it cannot be accidentally removed or moved inward to pierce the bag. For dispensing, the barrel is forcibly pushed in to dislodge the tooth from the first groove, cause the blade tips to pierce the fluid-containing bag, and latch the tooth into the second groove to prevent any removal of the barrel from the sleeve.

The invention also includes a removable assembly for remote dispensing of the fluid. This assembly pierces the bag, expands a ring of small balls into the first annular groove for temporarily locking the assembly and then can be removed by retracting the balls from the annular groove.

5 Claims, 6 Drawing Figures

FLUID DISPENSER

CROSS-REFERENCE TO RELATED APPLICATIONS

The invention described and claimed herein is related to inventions disclosed in U.S. Pat. No. 4,355,737, issued May 5, 1982, U.S. Pat. No. 4,421,297, issued Dec. 20, 1983, and in copending application Ser. No. 396,621, filed July 8, 1982 which describes and claims a fluid dispenser which opens a fluid-containing bag by rotational inward movement of the dispenser barrel and controls the dispensing by rotation of the barrel within its coaxial outer sleeve.

BRIEF SUMMARY OF THE INVENTION

This invention relates to bulk fluid containers and particularly to a novel fluid dispenser for small bulk fluid containers such as those having a relatively rigid outer box of corrugated paper board and a flexible, sealed, fluid-containing inner bag. Specifically, the dispenser is novel in that the fluid-containing bag is opened by inward or longitudinal movement of the dispenser barrel within its coaxial outer sleeve at which point the barrel becomes locked against further longitudinal inner or outward movement. Dispensing of the fluid is accomplished by rotation of the barrel within the sleeve.

Boxed bulk fluid containers of the type for which this invention is intended are especially valuable for the shipping, storage and dispensing of fluids that may become contaminated or otherwise deteriorated when exposed to an oxidizing atmosphere. In general, such containers employ a dispenser having a flange welded to a bag of flexible plastic material that will not deleteriously affect the fluid contained therein. The bag is filled, sealed, and placed in an outer container box of corrugated cardboard or the like.

If properly filled and sealed, the bag will contain no air or other gases that may damage the fluid during storage. When ready for use, a dispenser having a sharp point or cutting edge is inserted through the center of the flange to pierce the plastic bag and provide a valved dispenser for the fluid such as described in my U.S. Pat. No. 4,322,018, and others. As the fluid is dispensed from the container, the flexible plastic bag correspondingly shrinks in volume without admitting any air. Therefore, if the container is used for the storage and dispensing of an oxygen sensitive fluid such as wine, a partially filled container may be stored for long periods of time without danger of oxidation and souring of the contents.

There are several types of fluid dispensers that have pointed barrels for piercing the surface of the fluid container when pushed inward. For example, U.S. Pat. No. 3,239,104 to Scholle describes a four-piece dispenser having a barrel that pierces the fluid-containing bag and engages a bayonet-type socket that prevents accidental removal of the dispenser. U.S. Pat. No. 3,642,172 to Malpas discloses a three-piece dispenser having a pointed central barrel within a coaxial tubular sleeve having a flange that engages a socket attached to the surface of a fluid-containing bag. In all of the above systems, the dispenser itself is stored prior to its actual use at some remote location since actual attachment of the dispenser to their respective sockets which are attached to the fluid-containing bag could easily result in the accidental and premature piercing of the bag during transporting and handling.

In those dispensing systems that store the dispenser apart from the fluid container, an additional removable cap or plug is required to temporarily close the open socket prior to the attachment of the dispenser itself. Thus, for example, a three-piece dispenser such as described by Malpas in his U.S. Pat. No. 3,642,172 has, in addition to the normal three-piece structure of the dispenser, a fourth piece to cap the socket attached to the fluid-containing bag for preventing contaminants from entering the socket prior to insertion of the barrel and sleeve dispenser. This, of course, adds to the expense of the dispensing system.

Dispensing systems that employ separate storage of the bag-piercing dispensing element from the fluid bag operate very satisfactorily but have disadvantages that are overcome by two-piece dispensers that are permanently attached to the fluid bag but which also include some means for preventing accidental piercing of the bag. For example, a detached dispenser element may easily be lost in transit. Or it may be contaminated by contact with some foreign substance or atmosphere unless it is sealed in some form of wrapper that, itself, constitutes still another element of the fluid-dispensing system. A further disadvantage of the detached dispensing systems is that it may be easily pulled from their sockets before the fluid bag has been drained with the result that the fluid will spill in an uncontrolled flow from the bulk container.

The dispenser disclosed herein contains only two pieces: an outer sleeve and an inner barrel. It is simple and inexpensive to mold and to affix to the fluid-containing bag and, once actuated to pierce the bag, cannot be accidentally removed. The outer sleeve which is welded to the bag outer surface has two annular locking rings in the bore that mate with teeth on the outer surface of the rotatable barrel within the sleeve. One ring strongly resists longitudinal movement of the barrel and the second ring permanently prevents removal of the barrel after the fluid bag has been opened.

Briefly described, the dispenser of the invention comprises a simple two-piece unit having an outer tubular sleeve with one end attached to a flexible plastic fluid-containing bag, and an inner barrel having sharpened resilient cutting blades at its first end and sealed at its second or handle end. The plurality of short teeth radially extend outward from the resilient cutting blades and engage a first radial groove in the bore of the sleeve at a point where the cutting blades cannot reach the bag surface. To open the bag, the bag is forced inward so that the radial teeth are sprung from their first radial groove and into a second groove positioned at a point where the cutting blades have punctured the bag. The radial teeth and second groove are configured so that the barrel cannot thereafter be forced out from the sleeve. Dispensing of the fluid can be accomplished by rotating the sleeve to align two radial dispensing holes in the sleeve and barrel.

Also disclosed is a novel removable metal barrel that may be inserted into the sleeve to conduct the fluid from the fluid container through a suitable hose or conduit to a remote point where the fluid may be dispensed through a conventional tap.

BRIEF DESCRIPTION OF THE DRAWINGS

In the drawings which illustrate a preferred embodiment of the invention.

DETAILED DESCRIPTION OF THE PREFERRED EMBODIMENT

Figure 1:
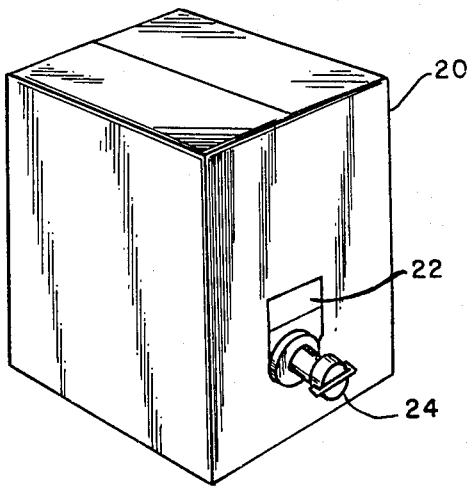
FIG. 1 is a perspective view of a fluid-container box illustrating the fluid dispenser.
Figure 2:
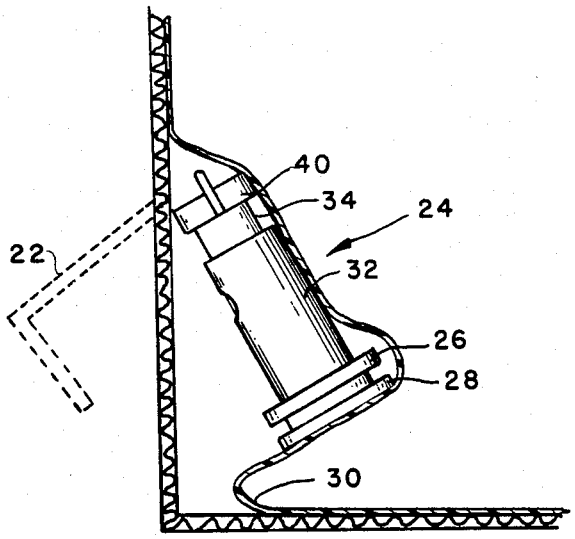
FIG. 2 is a cross-sectional elevation view illustrating the dispenser of FIG. 1 within the container.

Illustrated in the perspective view of FIG. 1 is a fluid-container box 20 of corrugated paper board or similar materials having a suitable bursting strength to support a sealed inner container of a suitable plastic material containing a liquid. Near the lower end of the front surface of the box 20 is a rectangular shaped flap 22 scored through the wall of the container so that it may be lifted to expose a fluid-dispenser 24, stored prior to its use behind the flap 22 as illustrated in FIG. 2. When ready for use, the dispenser 24 is withdrawn and a slot formed between spacing annular rings 26 and 28 on the dispenser sleeve engages the corresponding slit formed by the removal of the flap 22.

Figure 3:
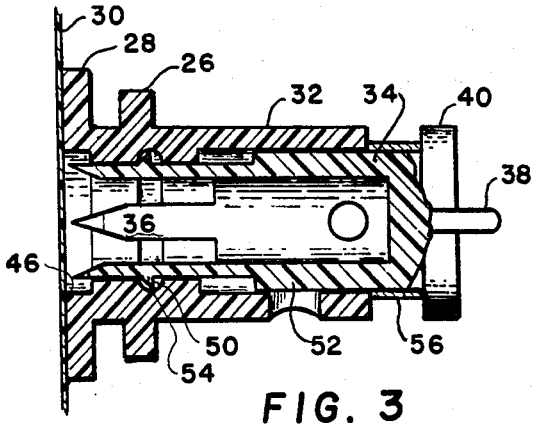
FIG. 3 is a sectional elevation view of the dispenser illustrating the inner barrel positioned in its locked position for storage and transit.

As illustrated in FIG. 2 and in greater detail in FIG. 3, the flange formed by the innermost ring 28 is cemented or otherwise firmly attached to the surface of a plastic fluid container bag 30 which is usually fabricated from several plies of various plastic material to obtain a puncture-resistant, strong bag that is impervious to air and moisture. As illustrated in the figures, the plastic surface of the bag 30 is stretched over the inner end of the dispenser to form a sealed diaphragm which is opened by the dispenser only when the contents of the bag are to be withdrawn.

FIG. 3 is a sectional elevation view of the dispenser 24 and illustrates a tubular sleeve 32 containing a coaxial tubular barrel 34. One end of the barrel 34 designated the inner end is provided with a plurality of longitudinal blades 36, with sharpened tips. The opposite or other end of the barrel 34 is provided with the handle 38 attached to an end cap 40 that seals the outer end of the barrel 34.

Figure 5:
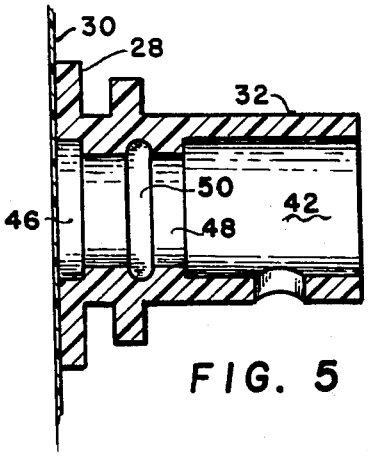
FIG. 5 is a sectional elevation view of the sleeve portion of the dispenser.

As best illustrated in FIG. 5, sleeve 32 has a relatively large diameter bore 42 in the end opposite the flange ring 28 and occupying approximately one-half the length of the sleeve. A dispensing hole 44 is radially formed in the wall of the sleeve 32 near the center of the length of the bore. A channel 46, having a rectangular cross-section and the width approximately the same as the flange 28 is formed in the bore of the sleeve 32 at the end adjacent the flange 28. The overall diameter of the channel 46 is substantially the same as that of the large diameter bore 42. Between the large diameter bore 42 and the channel 46 is a bore 48 of smaller diameter which contains therein an annular channel 50. The outside diameter of channel 50 is substantially the same as the large diameter bore 42, it is located approximately in the center of the small diameter bore 48, and it has a substantially semicircular cross-section.

Returning now to FIG. 3, the tubular barrel 34 is adapted to fit within the bore of the sleeve 32 and the barrel 34 therefore has a section 52 having an outside diameter substantially equal to the larger diameter bore 42 of the sleeve 32 and a length corresponding to the length of the larger diameter bore 42 of the sleeve. As with the sleeve 32, the barrel 34 also has a smaller diameter section corresponding to the smaller bore 48 of the sleeve, and in this smaller diameter section of the barrel is formed a plurality of elongated resilient blades 36 sharpened at their tips as previously indicated. Radially located in the outside of at least one of the blades 36 is a radial tooth 54 which is preferably triangular in cross-section with the vertical leg of the triangle normal to the surface of the teeth and facing toward the barrel end cap 40, as illustrated in FIG. 3. The radial teeth 54 are located on the elongated longitudinal blades 36 at a point where the cutting tips of the blades 36 are not yet in contact with the diaphragm formed by the plastic bag 30. Therefore, the radial teeth 54 in the annular channel 50 provide a stop which prevents the sharpened tips of the blades 36 from piercing the bag diaphragm.

If desired, an additional precaution against accidental piercing of the diaphragm may be taken by the addition of a thin "peel strip" 56 which may, if desired, be a horseshoe-shaped member, or an adhesive band placed around the exterior of the barrel between the end of the sleeve 32 and the end cap 40.

Figure 4:
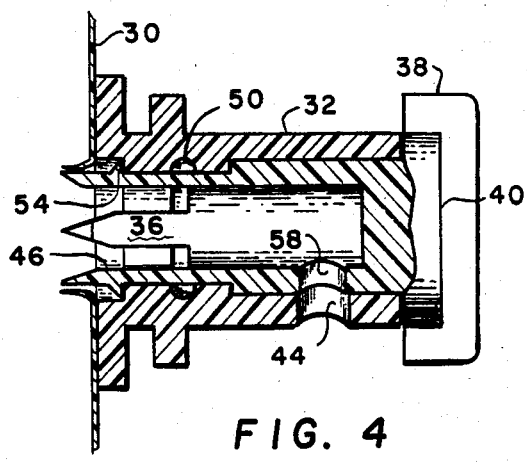
FIG. 4 is a sectional elevation view of the dispenser locked in its dispensing position.

FIG. 4 is a sectional elevation view of the dispenser of FIG. 3 after removal of the peel strip 56, if present, and the forcing of the barrel 34 longitudinally in the coaxial sleeve 32 to the point where the tips on the blades 36 have pierced the diaphragm formed across the bore of the sleeve by the bag 30. The radial teeth 54 on the elongated resilient longitudinal blades 36 have been forced within the annular channel 50 and into the end annular channel 46. It will be noted that the vertical portion of the triangular radial tooth 54 now engages a corresponding vertical side wall in the rectangular channel 46 to thereby automatically lock the barrel 34 against removal from the sleeve 32. It will also be noted that FIG. 5 illustrates the handle 38 rotated a quarter of a turn so that a radial dispensing hole 58 through the wall of the barrel 34 becomes aligned with the radial dispensing hole 44 in the sleeve 32 so that fluid may flow through the pierced bag 30, the bore of barrel 34 and out through the aligned dispensing holes 44 and 58. The rotation of the handle 38 in either direction misalign the dispensing holes 44 and 58 to shut off the flow of fluid.

It is often desired to store a bulk fluid container at some location and to dispense the fluid from a tap at a different location.

Figure 6:
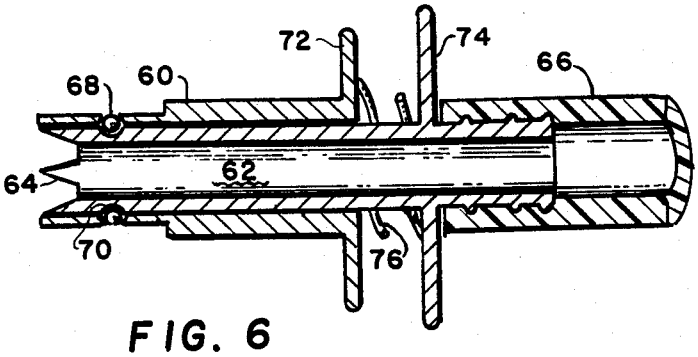
FIG. 6 is a sectional view of an auxiliary removable barrel for piercing the fluid container for dispensing the contents at a remote location.

FIG. 6 is a sectional elevation view of a removable barrel assembly adapted to fit within the sleeve 32 of the dispenser. When initially delivered, the bulk fluid container includes the barrel 34 as illustrated in FIG. 2. The radial tooth 54 on the cutting blades of the barrel engages the semicircular channel 50 within the bore of the sleeve 32 but, because of the configuration of the channel 50, the barrel 34 may be withdrawn from the sleeve provided it has not been longitudinally pushed inward to pierce the fluid bag and permit the radial tooth 54 from entering the annular channel 46. Therefore, if desired, the barrel 34 may be withdrawn and discarded and the removable barrel assembly of FIG. 6 inserted into the sleeve 32. It will be noted that the assembly of FIG. 6 includes an outer tubular sleeve 60 and a coaxial inner barrel 62. One end of barrel 62 is provided with sharpened blades 64 for piercing the fluid-containing bag 30. The opposite end of the barrel 62 is provided with a convenient fitting for attaching a tube 66 which may lead to the remote tap, not shown. As with the barrel 34 of FIGS. 3, 4 and 5, the outer sleeve 60 of FIG. 6 is adapted to fit within the bore of sleeve 32 such as illustrated in FIG. 5.

At two or more equally spaced points around the circumference of sleeve 60 are radial holes which house and retain a corresponding number of small balls 68 which rest in an annular groove 70 formed in the exterior surface of the inner barrel 62, as illustrated. The position of the radial holes and balls 68 is such that the blade end of the sleeve 60 will not yet come in contact with the surface of the fluid-containing bag 30 when the balls recessed within the annular groove 70 in the barrel 62 are aligned with the semicircular annular channel 50 in the smaller diameter bore 48 of the sleeve 32 of FIG. 5.

The exterior end of the sleeve 60 of FIG. 6 is provided with an annular disc 72, and a second disc 74 is formed around the exterior of the barrel 62 adjacent the connector for the dispensing hose 66. A tension spring 76 interconnects the discs 72 and 74 and operates to draw them together so that the balls 68 will no longer ride in the annular groove 70 of the barrel 62 and are forced outward and into the semicircular annular channel 50 in the sleeve 32 to thereby clamp the dispensing apparatus in the sleeve. When the discs 72 and 74 are drawn close together, the sharpened teeth 64 in the end of the barrel 62 will pierce the fluid-containing bag 30 so that the fluid will flow through the bore of the barrel 62 and the hose 66 to their remote dispensing tap.

To withdraw the removable assembly of FIG. 6, it is only necessary to force apart the discs 72 and 74 so that the balls 68 will again rest in the annular groove 70. Thus, the piercing and dispensing assembly of FIG. 6 may be rapidly removed and inserted into a fluid container by forcing apart the rings 72 and 74 and against the force provided by the spring 76.

I claim:

1. In combination with a flexible, sealed, fluid-containing bag, a two-piece dispenser comprising:

a tubular sleeve having at its first end a flange attached to the exterior surface of the fluid-containing bag, the longitudinal axis of said sleeve being substantially perpendicular to said bag surface covering the bore of said sleeve at said first end;

a tubular barrel slidably positioned within the bore of said tubular sleeve, said barrel having a first end adjacent the first end of said sleeve and said sealed bag surface, opening means comprising a plurality of flexible elongated blades formed in the end of said barrel adjacent its first end, said blades having sharpened tips for piercing through the surface of said fluid-containing bag covering the bore of said sleeve;

locking means for preventing removal of said barrel from said tubular sleeve after said opening means has opened said fluid-containing bag, said locking means including a tooth radially extending from the outer surface of at least one of said flexible, elongated blades, and a first annular channel in the bore of said sleeve adjacent the first end thereof, said tooth being positioned to engage said channel when said barrel has been longitudinally moved toward the first end of said barrel and the tips of said elongated blades have pierced said fluid-containing bag; and temporary locking means restricting the longitudinal movement of said barrel within said sleeve at the point where the tips of said blades are not in contact with the surface of said fluid-containing bag, said temporary locking means including a second annular channel having a substantially semicircular cross-section within the bore of said sleeve and displaced from said first annular channel toward the second end of said sleeve, said tooth radially extending from at least one of said flexible blades being in engagement with said second channel.

2. The fluid dispenser claimed in claim 1 further including fluid valving means including a radial dispensing aperture through the wall of said tubular sleeve and through the wall of said tubular barrel and adjacent the second ends of said sleeve and barrel for controlling the flow of fluid from said fluid containing bag through the bore of said barrel by the rotation of said barrel in said sleeve.

3. The fluid dispenser claimed in claim 2 further including a handle at the second end of said tubular barrel for the manual rotation of said barrel within said sleeve.

4. The fluid dispenser claimed in claim 1 further including second temporary locking means including a removable band around the outer surface of said barrel between said second end of said sleeve and said handle.

5. In combination with a flexible, sealed, fluid-containing bag, a fluid dispensing assembly including: a tubular sleeve having at its first end a flange attached to the exterior surface of the fluid-containing bag, the longitudinal axis of said sleeve being substantially perpendicular to said bag surface covering the bore of said sleeve at its first end, said sleeve having an annular channel with a substantially semicircular cross-section within the bore of said sleeve and displaced from said first end surface; and a removable tubular barrel adapted to slidably fit within the bore of said sleeve, said removable barrel comprising:

an inner tubular barrel having sharpened blades at the first end and a tube fitting at the second end thereof, said inner tubular barrel having an annular groove with a substantially semicircular cross-section, said groove being displaced from the tips of said sharpened blades by an amount less than the displacement of said annular sleeve channel;

an outer tubular sleeve having an exterior surface substantially corresponding to the bore of said tubular sleeve attached to said bag, said outer tubular sleeve having a plurality of small ball-retaining holes in communication between its outer and inner surfaces and in an annular pattern overlying the annular groove in said inner tubular barrel whereby the small balls are recessed from the outer surface of said outer tubular sleeve and lie in said annular groove; and spring means connected between said outer tubular sleeve and said inner tubular barrel and operating to force the first end of said inner tubular barrel outward from the corresponding end of said outer tubular sleeve to cause said sharpened blades toward said fluid-containing bag and to force said small balls from their recessed position in said annular groove into engagement with said annular channel in the bore of said sleeve that is attached to said bag.

* * * * *